US007285743B2

(12) United States Patent
Martin

(10) Patent No.: US 7,285,743 B2
(45) Date of Patent: Oct. 23, 2007

(54) SHIELDED ENCAPSULATED VACUUM INTERRUPTER

(75) Inventor: Donald R. Martin, New Lenox, IL (US)

(73) Assignee: G & W Electric Co., Blue Island, IL (US)

( * ) Notice: Subject to any disclaimer, the term of this patent is extended or adjusted under 35 U.S.C. 154(b) by 97 days.

(21) Appl. No.: 11/318,298

(22) Filed: Dec. 23, 2005

(65) Prior Publication Data

US 2006/0096856 A1 May 11, 2006

Related U.S. Application Data

(63) Continuation of application No. 10/685,723, filed on Oct. 15, 2003, now abandoned.

(51) Int. Cl.
*H01H 33/66* (2006.01)

(52) U.S. Cl. ..... 218/138; 218/136; 218/155

(58) Field of Classification Search ..... 218/134, 218/138, 139, 140, 147, 153–155, 7, 10, 218/14, 42, 77, 78, 118–122
See application file for complete search history.

(56) References Cited

U.S. PATENT DOCUMENTS

| | | | | |
|---|---|---|---|---|
| 3,147,356 | A | 9/1964 | Luehring | |
| 3,818,407 | A | 6/1974 | Edgerton | |
| 3,909,570 | A * | 9/1975 | Harner et al. | 218/150 |
| 3,946,351 | A | 3/1976 | Bronikowski et al. | |
| 3,955,167 | A | 5/1976 | Kumbera | |
| 4,002,867 | A | 1/1977 | Cherry | |
| 4,060,785 | A | 11/1977 | Hanke et al. | |
| 4,136,339 | A | 1/1979 | Kuhn | |
| 4,568,804 | A | 2/1986 | Luehring | |
| 4,618,749 | A | 10/1986 | Böhme et al. | |
| 4,661,665 | A | 4/1987 | Carroll et al. | |
| 4,692,733 | A | 9/1987 | Oakes | |
| 4,698,469 | A | 10/1987 | Pham et al. | |
| 5,597,992 | A | 1/1997 | Walker | |
| 5,808,258 | A | 9/1998 | Luzzi | |
| 5,903,209 | A | 5/1999 | Stepniak | |
| 7,148,441 | B2 * | 12/2006 | Daharsh et al. | 218/136 |

FOREIGN PATENT DOCUMENTS

DE 41 29 008 A1 1/1992

OTHER PUBLICATIONS

International Search Report, PCT/US04/31103, dated Nov. 18, 2004.

* cited by examiner

*Primary Examiner*—Elvin Enad
*Assistant Examiner*—M. Fishman
(74) *Attorney, Agent, or Firm*—Michael Best & Friedrich LLP

(57) ABSTRACT

A shielded encapsulated vacuum interrupter with a ceramic vacuum chamber and opposing conductive end caps is provided. One end cap is electrically connected to a fixed contact, while an opposing end cap is connected to a moving contact. The moving contact is actuatable with the fixed contact for opening or closing an electric circuit. A floating shield inside the vacuum chamber connected to the vacuum chamber ceramic wall and spaced from the fixed and moving contacts is isolated and has a floating voltage potential. A portion of the vacuum chamber exterior ceramic wall is coated with a semi-conductive material and conductive voltage screens enclose a portion of the vacuum chamber exterior and are electrically connected to each conductive end cap of the vacuum chamber. The chamber and connected screens are encapsulated in a molded dielectric housing.

25 Claims, 8 Drawing Sheets

SHIELDED ENCAPSULATED VACUUM INTERRUPTER

PRIORITY CLAIM

This application is a continuation of allowed U.S. patent application Ser. No. 10/685,723, filed Oct. 15, 2003, now abandoned the disclosure of which is hereby incorporated by reference.

TECHNICAL FIELD

The present invention pertains to current interrupting devices for power distribution systems. More particularly, the present invention relates to encapsulated vacuum interrupting devices for shielded power distribution systems.

BACKGROUND

Now more than ever, electric utility power distribution systems are being constructed underground due to public outcry about esthetics of aerial (i.e., above-ground) distribution systems in what is now known as the Not In My Backyard (NIMBY) phenomenon. To appease the NIMBY contingent, power distribution systems formerly constructed of poles, wires, and pole-mounted switches and transformers are being superceded and even replaced by underground systems constructed of conduits or duct-banks, underground vaults, cables, and ground level or sub-ground level switchgear and transformers. Underground systems pose new operational and maintenance challenges by virtue of being largely unseen. In response to these challenges, organizations such as the Institute of Electrical and Electronics Engineers (IEEE) and American National Standards Institute (ANSI) have implemented standards and codes to insure operating personnel safety and proper system performance. However, at times, personnel safety may conflict with system performance. One such standard recommends the grounding (i.e., shielding) of individual underground distribution system components at multiple system points (e.g., cable splices, transformers, switches). By grounding system components (or their enclosures), a system operator seeks to eliminate accessibility to hazardous voltages by operating personnel.

Vacuum interrupting switches are well known for use in power distribution systems for reliable interruption of fault current and load breaking, and have become effective substitutes for air, oil, and SF6 filled switches. When used in underground applications such as vaults or switchgear where there is a high probability of submersion, vacuum interrupting switches are enclosed or encapsulated in electrically insulating material. To ground a submersible vacuum interrupting switch in order to protect personnel from hazardous voltages, the entire switch exterior must be conductive. However, if the switch is grounded, the electric fields inside the device become distorted and reduce the dielectric withstand capability of the open gap during a switch "break" operation. Mitigation of this electric field distortion has so far been elusive to those knowledgeable in the art.

U.S. Pat. No. 4,618,749 to Bohme et al. discloses a vacuum switching apparatus inserted into an insulating material such as epoxy resin. The Bohme et al. switch also has a metallic cover which can be grounded for personnel safety. The disclosed switching apparatus is not integrally molded into the insulating material and a space exists between the apparatus and insulating material. Bohme et al. recognize that the space is susceptible to capacitive discharge due to breakdown of the insulating material (e.g., corona effect) especially during times when the switch contacts are open. Control electrodes embedded in the insulating material attempt to minimize corona effect inside the space by placing voltage stress in the insulating material. It is readily apparent to one knowledgeable in the art that the Bohme et al. device will still suffer from insulating material breakdown. Furthermore, as the switching apparatus is inserted in the preformed insulating housing, the device is expensive and complicated to manufacture.

Thomas & Betts Elastimold® MVI Molded Vacuum Fault Interrupter attempts to overcome the deficiencies of the aforementioned Bohme et al. patent by directly encapsulating the vacuum switch chamber in a molded insulating housing. The voltage stress is now present in the insulating housing which has a much higher breakdown strength. However, since the MVI device is shielded, the presence of a grounded surface in close proximity to the vacuum chamber causes an electric field distortion inside the device which decreases the withstand capability of the open gap. Thus, the device is prevented from operating to its full potential.

The present invention provides a device that overcomes the disadvantages of the prior art. These and other advantages of the invention, as well as additional inventive features, will be apparent from the description of the invention provided herein.

BRIEF SUMMARY

The invention provides a shielded encapsulated vacuum interrupter. A ceramic vacuum chamber includes opposing conductive end caps. One end cap is electrically connected to a fixed contact, while an opposing end cap is connected to a moving contact. The moving contact is actuatable co-axially with the fixed contact for opening or closing an electric circuit. A floating shield inside the vacuum chamber, connected to the vacuum chamber ceramic wall and spaced from the fixed and moving contacts, is isolated from the contacts and ground and has a floating voltage potential. A portion of the vacuum chamber exterior ceramic wall is coated with a semi-conductive material. Conductive voltage screens are electrically connected to each conductive end cap of the vacuum chamber, and the entire vacuum interrupter including the chamber and connected screens is then encapsulated in a molded dielectric housing.

DETAILED DESCRIPTION

Figure 1:
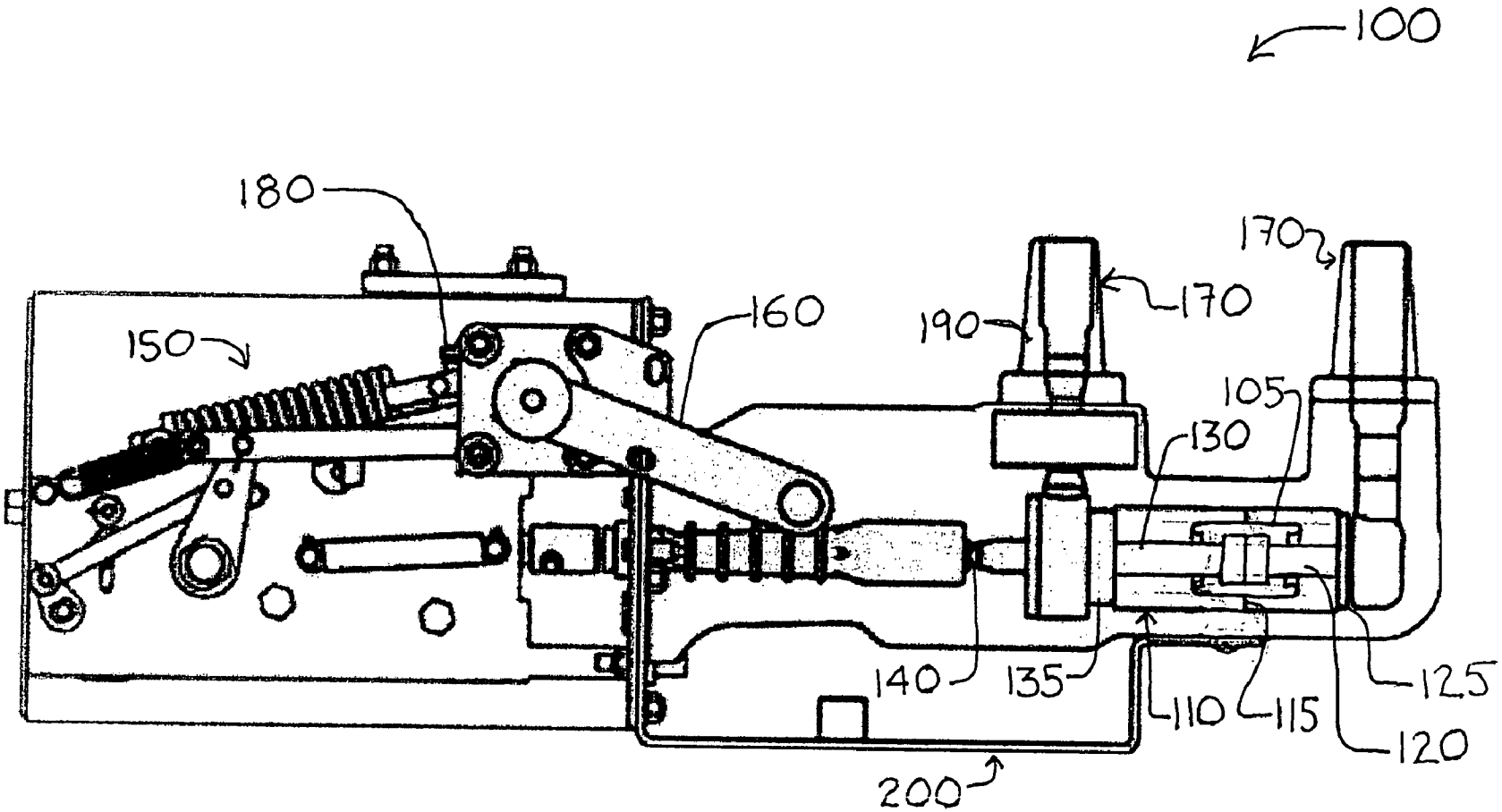
FIG. 1 is a cross-section view of an exemplary encapsulated vacuum interrupter without voltage screens.

Referring now to the drawings, FIG. 1 shows a cross-sectional view of the internal component arrangement of an exemplary vacuum interrupter 100. Vacuum interrupter 100 may be employed in a power distribution system to open or close an electric circuit. Current flow through the interrupter 100 may be interrupted or restored by vacuum chamber 110. Vacuum chamber 110 includes a generally cylindrical-shaped ceramic housing and two conductive end caps which seal the vacuum chamber and maintain a vacuum therein. Referring to FIG. 1, the vacuum chamber 110 has a "fixed" end and a "movable" end. A fixed contact 120 is disposed within the fixed end of vacuum chamber 110 and is in contact with conductive fixed end cap 125. A movable contact 130 is disposed within the movable end of vacuum chamber 110 and is coaxially aligned with fixed contact 120. Movable contact 130 is in electrical contact with end cap 135 and coaxially engages and disengages from fixed contact 120 to make or break an electric current running therethrough. Conductive movable end cap 135 may be a metallic bellows or the like which permits drive rod 140 to move movable contact 130 back and forth along the vacuum chamber axis while maintaining a sealed vacuum in vacuum chamber 110. Drive rod 140 may be actuated by an operating handle 160 connected to an operating mechanism 150 such as a spring. A contact position indicator 180 may also be included in interrupter 100 so an operator may visually inspect the interrupter to determine whether the contacts are in an open or closed position.

Vacuum chamber 110 also includes an floating shield 105 which is a metallic generally cylindrical-shaped member. Floating shield 105 is supported in vacuum chamber 110 at a fixed coaxial distance from the fixed contact 120 and movable contact 130 by exposed ring 115. The ceramic housing of vacuum chamber 110 includes two generally cylindrical ceramic portions which sandwich exposed ring 115 and retain floating shield 105 at a spaced distance from the contacts. Since floating shield 105 is retained at a spaced distance from the contacts, it is electrically isolated and has a floating voltage potential. During switching operation of the contacts, floating shield 105 prevents metallic ions released from the contacts when arcing occurs from collecting on the interior of the ceramic housing, thereby preventing performance degradation of the interrupter 100.

Figure 2:
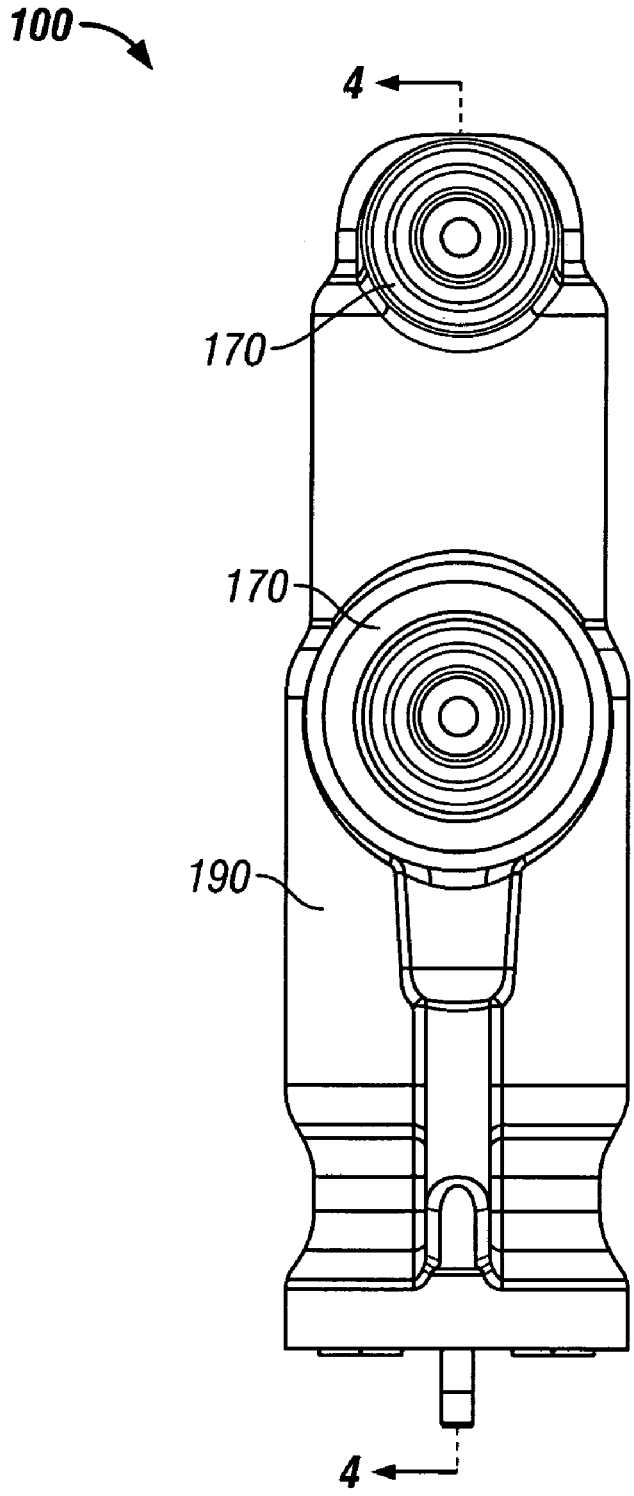
FIG. 2 is a front elevation view of an exemplary encapsulated vacuum interrupter with voltage screens.
Figure 3:
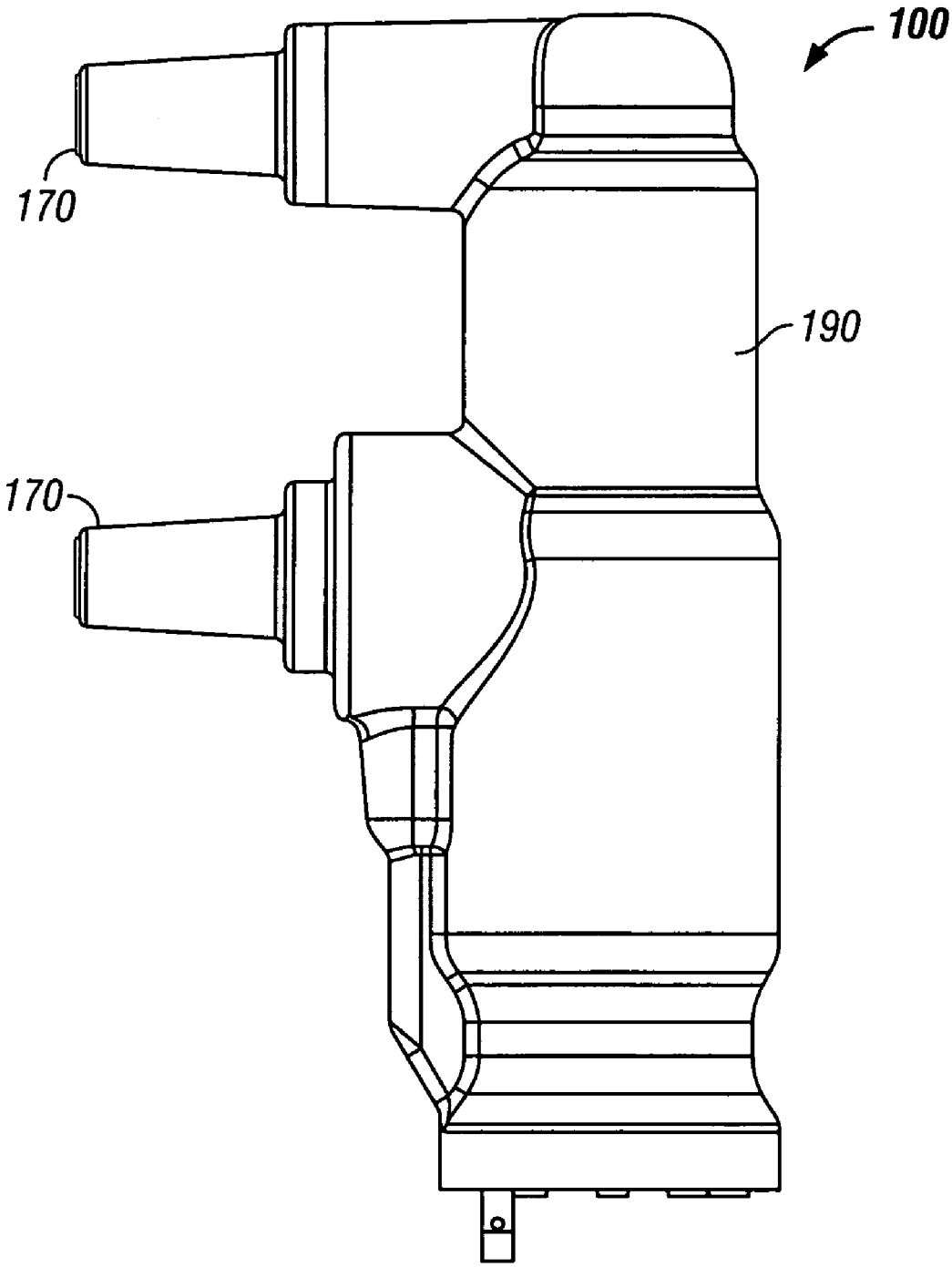
FIG. 3 is a side elevation view of the encapsulated vacuum interrupter of FIG. 2.
Figure 4:
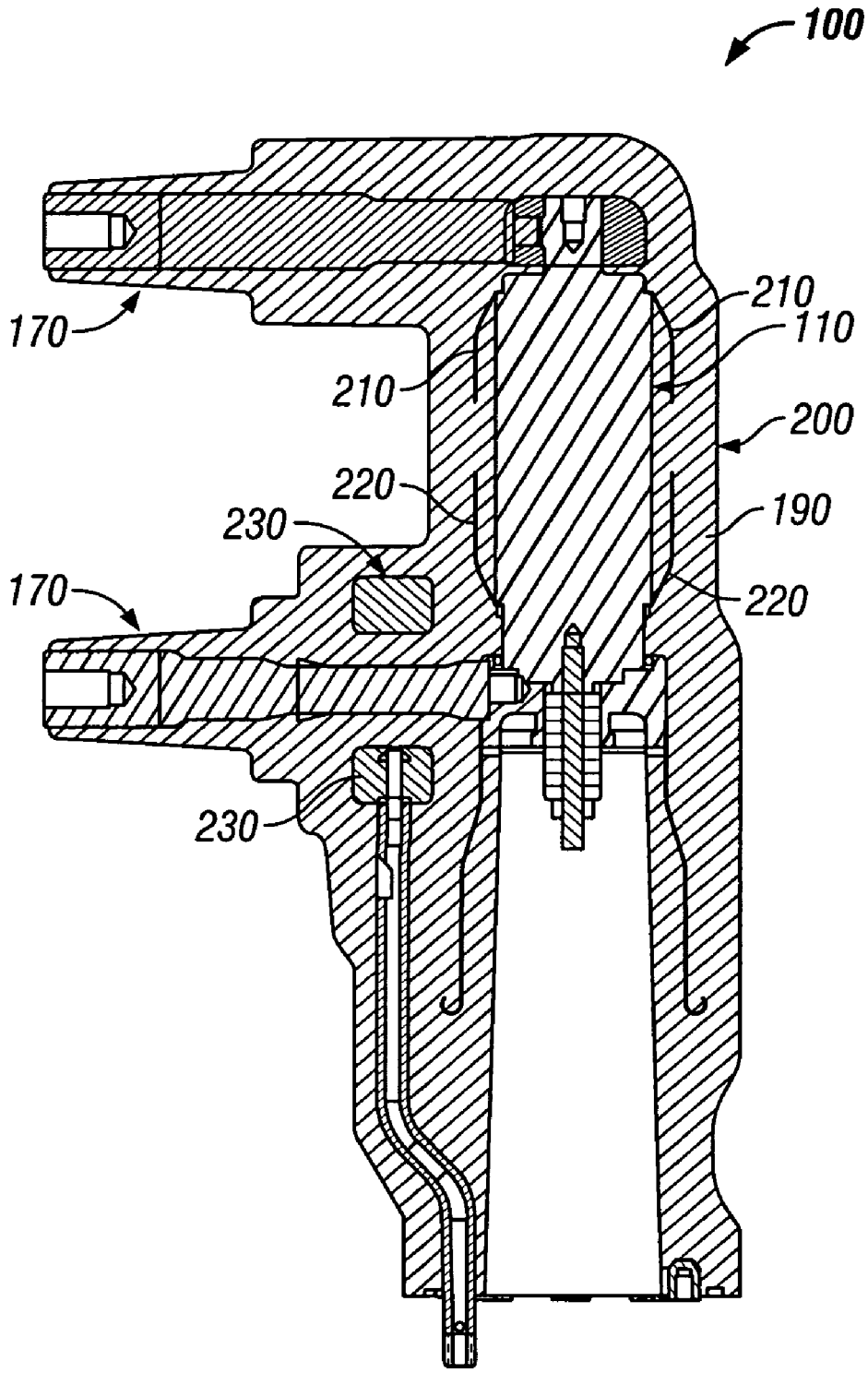
FIG. 4 is a side cross-section view of the encapsulated vacuum interrupter of FIG. 2 showing voltage screens and a current sensing device.

Conductive leads electrically connected to the conductive end caps serve as a connecting means for power distribution conductors such as underground cables to interface with the interrupter 100. To ensure that the vacuum interrupter 100 will operate reliably and safely in wet environments, such as underground vaults or switchgear prone to flooding, the interrupter is encapsulated in a molded dielectric material such as epoxy or the like. As shown in FIG. 1, encapsulation 190 may enclose a portion of the interrupter such as the leads and vacuum chamber 110. However, it is preferable that the vacuum interrupter 100 be completely encapsulated as is shown in FIGS. 2-4. To ensure the safety of operating personnel, the vacuum interrupter is shielded (i.e., grounded) by coating the outer surface of the encapsulation 190 with a semiconductive layer 200 which is at ground potential when installed in a shielded distribution system. One preferred semiconductive layer 200 is Electrodag 213, manufactured by the Acheson Colloids Company of Port Huron, Mich. Electrodag 213 is a dispersion of finely divided graphite pigment in an epoxy resin solution which has excellent adhesion to epoxy, plastic and ceramics.

Figure 6:
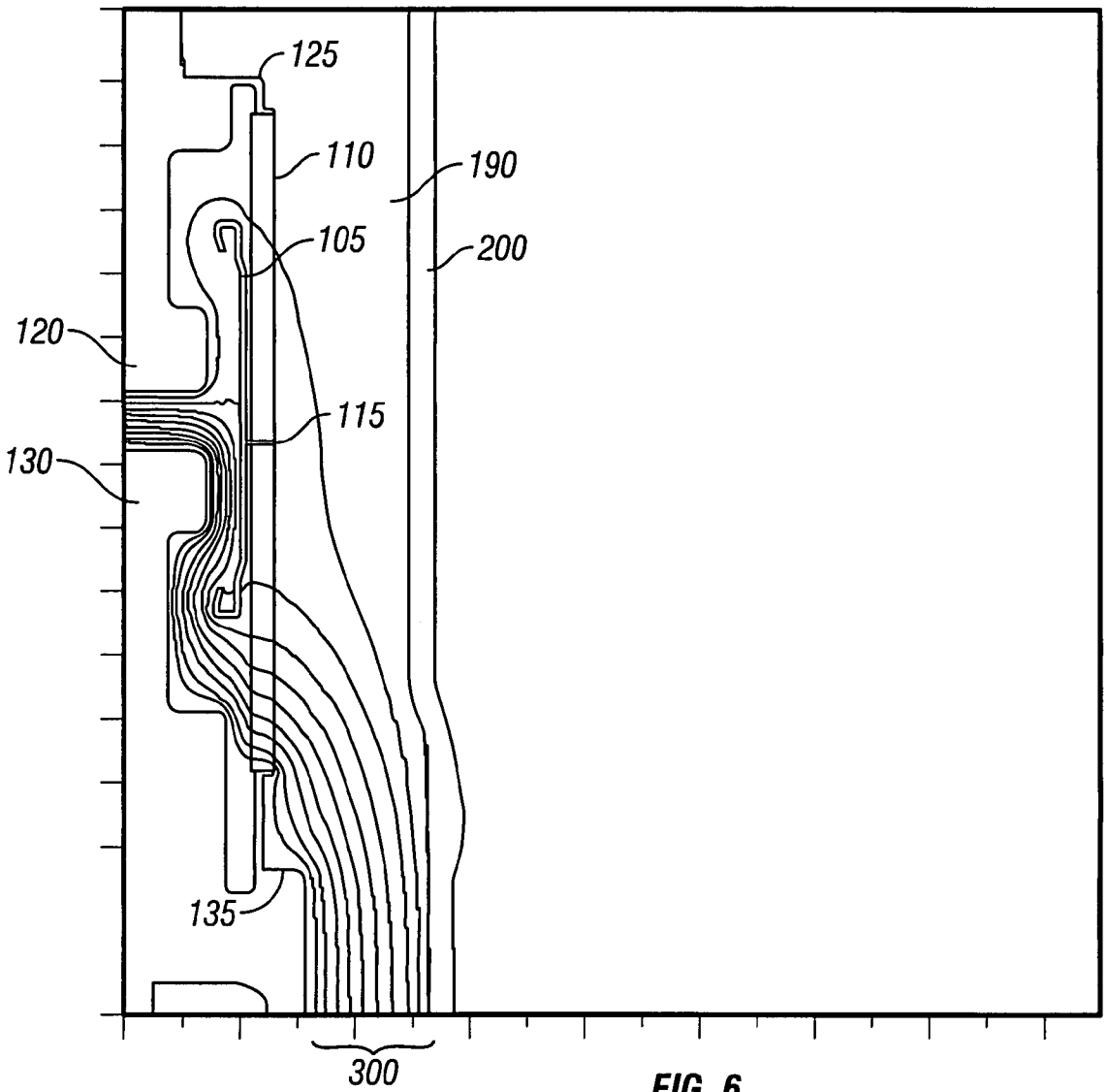
FIG. 6 is a finite element analysis of the encapsulated vacuum interrupter of FIG. 2 without voltage screens showing voltage stress distribution during a hi-pot test.

Bushings 170 are formed by encapsulating the conductive leads in the dielectric encapsulation 190. As shown in FIG. 4, a current sensing device 230, such as a current transformer (i.e., CT), may be molded into the dielectric encapsulation to sense fault currents and the like in order to actuate the vacuum interrupter 100. Current sensing device 230 may be in communication with an electronic control system or relay (not shown) which determines if a fault is present in the electric circuit and may operate a motor, solenoid, or the like to actuate operating lever 160 to disengage the movable contact 130 from fixed contact 120, thereby interrupting a current through the vacuum interrupter 100. When the contacts are disengaged from each other, a potential difference exists therebetween in the open gap which, depending on the power distribution system voltage level, can range from 4 kv to 34 kv. Since the semiconductive outer layer 200 of the vacuum interrupter 100 is at ground potential when installed in a shielded distribution system, the grounded surface in close proximity to the vacuum chamber 110 causes a severe electric field distortion inside the vacuum interrupter 100 which significantly reduces the withstand capability of the open gap. Referring to FIG. 6, a finite element analysis of a shielded encapsulated vacuum interrupter is shown. Movable contact 130 is disengaged from fixed contact 120 and an open gap exists therebetween. Electric field lines 300 in the vacuum interrupter 100 show a distorted distribution as they tend toward ground potential.

To counteract the electrical field distortion, voltage screens are attached to the vacuum chamber 110 and are embedded in the dielectric encapsulation 190 to place the voltage stress in the encapsulation. Fixed voltage screen 210 (FIG. 4) is electrically connected to the conductive end cap 125 while movable voltage screen 220 is affixed to the conductive movable end cap 135. On one exemplary embodiment, the voltage screens are preferably conductive bowl-shaped elements which are perforated metallic sheets or metallic mesh screens to facilitate bonding to the dielectric encapsulation.

Figure 5:
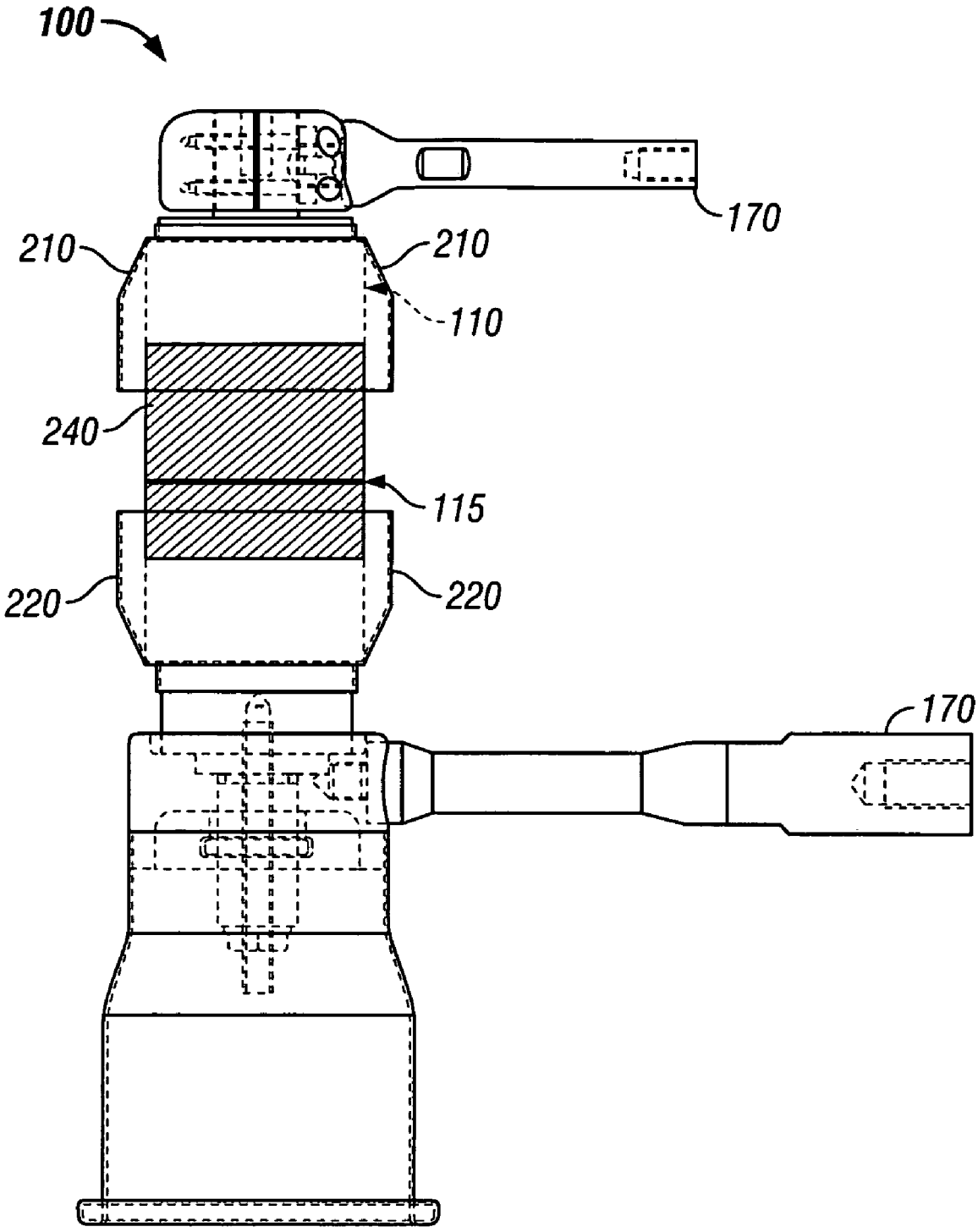
FIG. 5 is a side cross-section view of the encapsulated vacuum interrupter of FIG. 2 showing the voltage screens and semi-conductive coating to the vacuum chamber.

The two opposing voltage screens substantially enclose vacuum chamber 110, but leave a central portion exposed. As shown in FIG. 5, the central exposed portion of vacuum chamber 110 includes exposed ring 115 which supports floating shield 105. The exterior exposed central portion of vacuum chamber 110 is coated with a semiconductive material 240 which may be the same or different from the semiconductive exterior layer 200, such that the bands at the end portions of vacuum charger ceramic housing. The semiconductive material 240 may be a fluid paint, bonding agent, epoxy, or the like that has an electrically conductive property. A preferred semiconductive material is Epic S7076 manufactured by Epic Resins of Palmyra Wis. Epic S7076 is a carbon-filled, electrically conductive epoxy system that can be easily applied by hand or automatic dispensing equipment.

Semiconductive material 240 preferably extends into the areas encompassed by fixed voltage screen 210 and movable voltage screen 220. In this way, each voltage screen overlaps a portion of the applied semiconductive material 240. One knowledgeable in the art will understand that the semiconductive material 240 on the vacuum chamber exterior will assume the same potential as the floating shield 105 inside the vacuum interrupter 110 since they are linked by exposed ring 115. Therefore, when the contacts are separated, the semiconductive material 240 eliminates the voltage stress on the ends of the floating shield 105. Voltage screens electrically coupled to the fixed contact 120 and movable contact 130 drive the potential on the semiconductive coating 240 to 50% of the difference between the conductive end caps of the vacuum chamber 110 thereby achieving a balanced voltage potential distribution. The first voltage overlaps a first portion of a semiconductor material and forms a first capacitive path with the semiconductor material, and the second voltage screen overlaps a second portion of semiconductive material and forms a second capacitive path with the semiconductive material.

Figure 7:
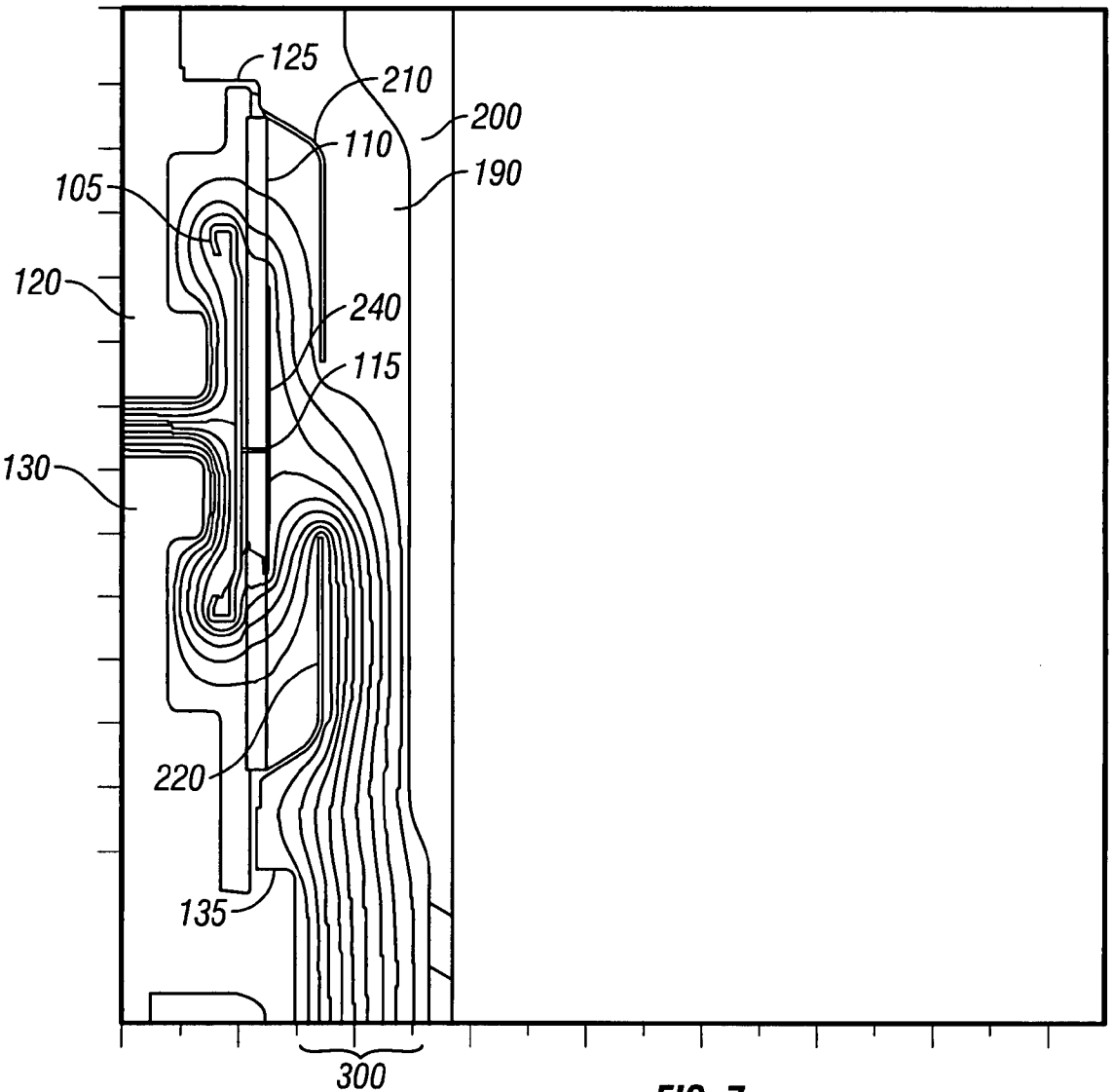
FIG. 7 is a finite element analysis of the encapsulated vacuum interrupter of FIG. 2 with voltage screens showing voltage stress distribution during a hi-pot test.
Figure 8:
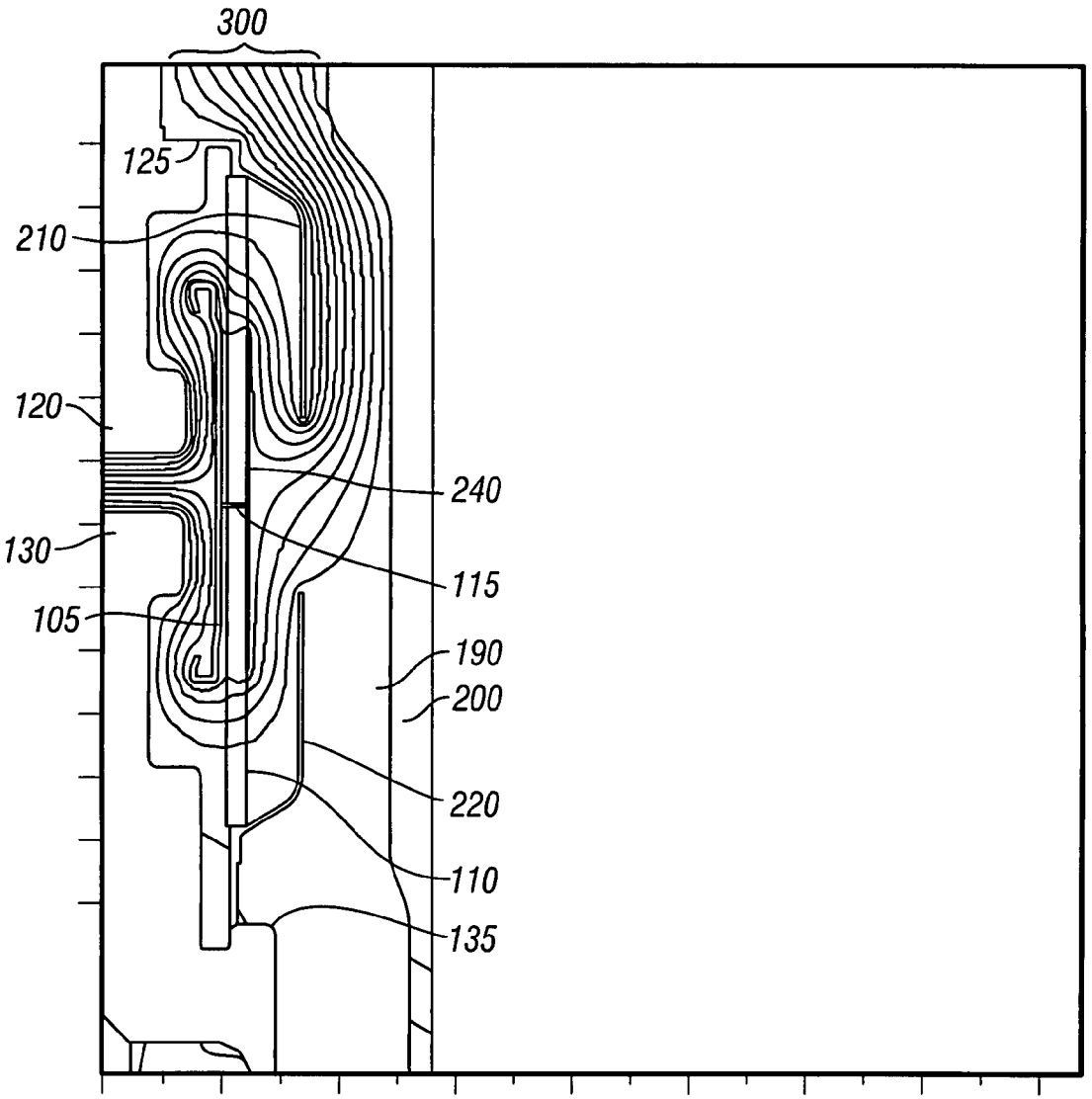
FIG. 8 is a finite element analysis of the encapsulated vacuum interrupter of FIG. 2 with voltage screens showing voltage stress distribution during a reverse hi-pot test.

Referring now to FIG. 7, a finite element analysis for a vacuum interrupter with fixed voltage screen 210, movable voltage screen 220, and semiconductive material 240 applied to the vacuum chamber 110 shows that electric field lines 300 are nearly symmetrically distributed inside the vacuum chamber in the open gap. FIG. 8 shows the identical vacuum interrupter of FIG. 7, but with voltage polarity reversed. As shown, the electric field lines 300 remain symmetrically distributed in the open gap.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A vacuum interrupter comprising:

dielectric encapsulation having a one-piece molded material and configured to substantially encapsulate the vacuum interrupter;

a vacuum chamber molded into the dielectric encapsulation, the vacuum chamber comprising:

a ceramic housing;

a first end cap sealing the housing;

a second end cap sealing the housing;

a floating shield within the housing; and an exposed ring coupled with the housing and the floating shield;

a semi-conductive material in contact with the exposed ring and disposed on a central exterior portion of the vacuum chamber ceramic housing such that bands at end portions of the vacuum chamber ceramic housing are substantially free of the semi-conductive material;

a first voltage screen connected to the first end cap and disposed outside the housing; and a second voltage screen connected to the second end cap and disposed outside the housing, said first voltage screen overlapping a first portion of the semi-conductive material, and forming a first capacitive path with the semi-conductive material, and said second voltage screen overlapping a second portion of the semi-conductive material, and forming a second capacitive path with the semi-conductive material.

2. The vacuum interrupter of claim 1 wherein the dielectric encapsulation is epoxy.

3. The vacuum interrupter of claim 1 wherein at least one of the voltage screens comprises a perforated metal sheet.

4. The vacuum interrupter of claim 1 wherein at least one of the voltage screens comprises a metallic mesh material.

5. The vacuum interrupter of claim 1 wherein at least one of the voltage screens is generally bowl-shaped.

6. The vacuum interrupter of claim 1 wherein the voltage screens substantially enclose the vacuum chamber.

7. The vacuum interrupter of claim 1 wherein the voltage screens are mirror images of each other.

8. A system for mitigating electric field distortion inside a shielded encapsulated vacuum interrupter comprising:

a vacuum chamber;

a floating shield within the vacuum chamber;

a semi-conductive material applied to an exterior central portion of the vacuum chamber, coupled with the floating shield, and disposed within the shielded encapsulation such that bands at exterior end portions of the vacuum chamber are substantially free of the semi-conductive material;

a first voltage screen electrically connected to a first end of the vacuum chamber, disposed within the shielded encapsulation, enclosing a first portion of the semi-conductive material, and forming a first capacitive path with the semi-conductive material; and a second voltage screen electrically connected to a second end of the vacuum chamber, disposed within the shielded encapsulation, enclosing a second portion of the semi-conductive material, and forming a second capacitive path with the semi-conductive material.

9. The system of claim 8 wherein the first and second voltage screens comprise a perforated metal sheet.

10. The system of claim 8 wherein the first and second voltage screens comprise a metallic mesh material.

11. The system of claim 8 wherein the first and second voltage screens are generally bowl-shaped.

12. The system of claim 8 wherein the first and second voltage screens are mirror images of each other.

13. The system of claim 8 wherein the first and second voltage screens substantially enclose the vacuum chamber exterior.

14. A method for mitigating electric field distortion inside a shielded encapsulated vacuum interrupter comprising:

providing a vacuum chamber comprising:

a first conductive endcap;

a second conductive endcap;

a floating shield within the chamber; and an exposed ring coupled with the floating shield and disposed on the exterior of the vacuum chamber;

disposing a first semi-conductive material on an exterior central portion of the vacuum chamber and contacting the exposed ring such that bands at exterior end portions of the vacuum chamber are substantially free of the semi-conductive material;

connecting a first voltage screen to the first conductive endcap;

disposing the first voltage screen exterior to the chamber so as to form a second capacitive path with the semi-conductive material;

connecting a second voltage screen to the second conductive endcap;

disposing the second voltage screen exterior to the chamber so as to form a capacitive path with the semi-conductive material;

encapsulating the vacuum chamber and voltage screens in molded dielectric material; and disposing a second semi-conductive material on the exterior of the molded dielectric material.

15. The method of claim 14 wherein the first and second voltage screens include a perforated metal sheet or a metallic mesh material.

16. The method of claim 14 wherein the first and second voltage screens are generally bowl-shaped.

17. The method of claim 14 wherein the first and second voltage screens substantially enclose the vacuum chamber and first semi-conductive material.

18. The method of claim 14 wherein the first and second voltage screens are mirror images of each other.

19. The method of claim 14 wherein the first semi-conductive material and the second semi-conductive material are the same.

20. The method of claim 14 wherein the molded dielectric material is epoxy.

21. A vacuum interrupter, comprising:

a dielectric encapsulation;

a vacuum chamber disposed within the dielectric encapsulation, including:

a floating shield disposed within the vacuum chamber; and an exposed ring electrically coupled with the floating shield and integral with the vacuum chamber;

a semi-conductive material disposed on an exterior of the vacuum chamber and coupled with the exposed ring; and a voltage screen coupled to and disposed outside the vacuum chamber, and forming a capacitive path with the semi-conductive material.

22. The vacuum interrupter of claim 21, wherein the voltage screen is embedded in the dielectric encapsulation.

23. The vacuum interrupter of claim 21, wherein the vacuum chamber includes an end cap, and the voltage screen is coupled to the end cap.

24. The vacuum interrupter of claim 21, further comprising a second voltage screen coupled to and disposed outside the vacuum chamber so as to form a second capacitive path with the semi-conductive material.

25. The vacuum interrupter of claim 24, wherein the vacuum chamber includes a second end cap, and the second voltage screen is coupled to the second end cap.

* * * * *